US005957396A

United States Patent [19]

Crum et al.

[11] Patent Number: 5,957,396

[45] Date of Patent: Sep. 28, 1999

[54] MOUNTING ASSEMBLY FOR SPRAY GUN WITH ANTI-BACK-IONIZATION PROBE

[75] Inventors: Gerald W. Crum, Elyria; Alan J. Knobbe, Amherst; Curtis B. Haller, Lorain, all of Ohio

[73] Assignee: Nordson Corporation, Westlake, Ohio

[21] Appl. No.: 08/959,723

[22] Filed: Oct. 28, 1997

Related U.S. Application Data

[63] Continuation of application No. 08/456,472, Jun. 1, 1995, abandoned.

[51] Int. Cl.[6] ..... B05B 5/025

[52] U.S. Cl. ..... 239/706; 239/708

[58] Field of Search ..... 239/600, 587.3, 239/587.4, 690–708, 3; 118/628, 323

[56] References Cited

U.S. PATENT DOCUMENTS

| | | | |
|---|---|---|---|
| 2,433,594 | 12/1947 | Calo . | |
| 2,573,904 | 11/1951 | Grossman | 239/587.4 X |
| 2,960,273 | 11/1960 | Croskey et al. | 239/704 |
| 3,116,856 | 1/1964 | Prussin et al. | 239/587.4 X |
| 3,279,429 | 10/1966 | Felioi et al. | 239/704 X |
| 3,408,995 | 11/1968 | Sedlacsik | 239/698 X |
| 3,441,222 | 4/1969 | Law | 239/280.5 |
| 3,558,052 | 1/1971 | Dunn | 239/3 |
| 4,568,027 | 2/1986 | Lazarus . | |
| 4,713,257 | 12/1987 | Luttermoller | 239/706 X |
| 4,779,564 | 10/1988 | Kiefer et al. . | |
| 4,921,172 | 5/1990 | Belmain et al. . | |

FOREIGN PATENT DOCUMENTS

| | | | |
|---|---|---|---|
| 0574305 | 12/1993 | European Pat. Off. . | |
| 444879 | 6/1912 | France | 239/280.5 |
| 85636 | 3/1952 | Germany . | |
| 3510199 | 10/1986 | Germany . | |
| 4022643 | 11/1991 | Germany . | |
| 865302 | 9/1981 | U.S.S.R. | 239/587.4 |

OTHER PUBLICATIONS

Patent Abstracts of Japan, vol. 017., No. 620 (E–1460), Nov. 16, 1993; relating to Japanese Patent Publication No. 05191689, published Jul. 30, 1993.

Campbell, "Electrostatic charging of powder coating material," *Finishing,* Jun. 1994, pp. 28, 30.

Acker, "Corona coating of powder without the orange–peel effect," publication unknown, date unknown.

*Primary Examiner*—Kevin Weldon
*Attorney, Agent, or Firm*—Rankin, Hill, Porter & Clark LLP

[57] ABSTRACT

A mounting assembly for adjustably mounting a spray gun onto a mounting bar comprises a ball-and-socket joint attached at one end to the bar and attached at the other end to the gun, and an adjustment sleeve extending along the exterior of the bar. The sleeve is attached to the ball-and-socket joint and adapted to tighten the socket around the ball when the sleeve is turned to retain the gun securely in a desired position with respect to the bar. The mounting assembly allows for positioning the spray gun in an almost limitless range of possible orientations, and allows the securing mechanism to be easily tightened and loosened by the operator by turning the adjustment sleeve. An anti-back-ionization probe is attached to the gun and extends externally to the gun along the top or side of the gun. The probe comprising an elongated rod, which is easily removable and easily adjustable in length.

14 Claims, 3 Drawing Sheets

MOUNTING ASSEMBLY FOR SPRAY GUN WITH ANTI-BACK-IONIZATION PROBE

This is a continuation of application Ser. No. 08/456,472, filed Jun. 1, 1995, now abandoned.

BACKGROUND OF THE INVENTION

1. Field of the Invention

This invention relates to electrostatic spray coating systems, and more particularly to the assembly by which spray guns are mounted for spraying coating material onto parts, and to a device for collecting free ions in an electrostatic spray coating system.

2. Description of the Prior Art

In electrostatic spray coating systems, the coating material is pumped from a supply to one or more spray guns which spray the coating material onto a product to be coated. The coating material may be either in the form of dry particles conveyed in a fluidized air stream or in the form of liquid atomized by the gun. The spray guns may charge the coating particles by means of a high voltage charging electrode. When the coating particles are sprayed from the front of the gun, they are electrostatically attracted to the product to be coated which is generally electrically grounded and suspended from an overhead conveyer in a spray booth. The spray guns are mounted in the spray booth, either in a stationary position or on a reciprocator or other device which allows the gun to be automatically moved in a predetermined path. Once these charged coating particles are deposited onto the product, they adhere there by electrostatic attraction until they are conveyed into an oven where they are cured, or, in the case of powder coating, melted to flow together to form a continuous coating on the product.

Previous gun mounts for spray guns have typically comprised a bracket mounted to the gun and connected to a mounting bar installed in the spray booth, with a knob used to tighten the bracket to the bar in the desired position. These gun mounts have performed adequately, but several problems have arisen in the use of these mounts.

The gun slot in the spray booth is sometimes narrow, and when the knob and the pivot from the mount were aligned with the wall of the booth, it could be very difficult for the operator to insert his hand into the booth, grip the knob, and turn the knob to loosen it in order to adjust the position of the gun or to remove the gun from the mounting bar. Even when the gun was in other positions, it could sometimes be difficult for the operator to twist the knob in order to tighten the knob sufficiently so that the gun was held securely.

When these gun mounts have been used on reciprocators, the mounts were subject to loosening, causing the spray gun to rotate and spray downwardly. The center of gravity of the spray gun is in front of the pivot and the knob. Each time the gun reaches the top of the reciprocator stroke, the gun rotates or swings upwardly at the nozzle. When this occurs, the gun swings counterclockwise, causing the gun mount pivot to be urged to rotate counterclockwise as well. This, in turn, caused the knob to rotate counterclockwise, which loosened the knob. Eventually, the knob could be so loose that the gun would pivot freely on the mount and, with the center of gravity in the front of the gun, the gun would swing to a position in which it sprayed downwardly.

The prior art gun mounts have also tended to be difficult to clean. Powder spray guns are subjected to an environment in which powder covers everything in the spray booth. The prior art gun mounts had surfaces that could easily collect powder. The knob, which required rough surfaces in order to be easily operated, was especially subject to undesirable collections of powder.

The prior art gun mounts have also lacked the capability of adjusting the horizontal gun position in order to spray toward the part as it is moving toward the gun on the conveyor, i.e., lead spraying, or to spray the part as it is moving away from the gun on the conveyer, i.e., lag spraying. The capability of lead and lag spraying can be quite useful in certain applications, such as coating vertical corners on the inside of drawers or cabinets. It is desirable that a gun mount allow the gun to be positioned in all possible positions, so that the gun can be moved or placed in the best position for coating a part.

The mounts have also generally been formed of injection molded plastic parts. When guns were moving on a reciprocator, the plastic parts often would be incapable of holding the gun in position so as to minimize gun movement at the nozzle. The two plastic screws which attached the mount to the multiplier would occasionally break. In addition, since the gun mounts were made of a nonconductive plastic material, the gun mounts could not be used for mounting of an anti-back-ionization (ABI) device, since the ABI device would need to be electrically grounded.

ABI devices have been found to be useful in attracting free ions which would otherwise be attracted to the part. Without an ABI device, the free ions are conveyed with the coating material onto the part. This causes a charge to accumulate on the deposited coating layer until the local electric field strength is great enough to cause ionization from the coating layer. This "back-ionization" can disturb the deposited coating and result in craters and other defects in the cured coating. By using an ABI device, the appearance of the surface finish on the part can be improved.

An example of an ABI device is shown in U.S. Pat. No. 4,921,172, issued to Belmain et al., in the form of a counter-electrode mounted on a powder spray gun on the front of the gun. Another example of an ABI device is shown in European Patent Publication No. 0,620,045 in the form of a counter-electrode ring fixedly mounted around the front of the gun. The existing ABI devices have generally been fixed in position or built into the gun and have not provided easy adjustment or removablity.

SUMMARY OF THE INVENTION

These and other problems are overcome by the combination gun mount and anti-back-ionization device of the present invention.

The gun mount of the present invention eliminates the knob associated with the prior art, and replaces it with an adjustment sleeve that extends along the mounting bar. The adjustment sleeve is oriented in a position that makes it easy for the operator to grip, even when the gun is aligned with the booth wall. By positioning the gripping surfaces on the adjustment sleeve, it is easy to tighten the mounting assembly sufficiently so that the position of the gun can be held securely. By eliminating the knob of the prior art gun mounts, the gun is less prone to become loose when used on reciprocators. The elimination of the knob also makes the gun much easier to clean, since there are fewer surfaces which can accumulate powder.

The gun mount of the present invention can also be adjusted so as to place the gun in almost every possible position, including a lead and lag position in which the gun is mounted in a horizontal position in order to spray toward the part as it is moving toward the gun on the conveyor, or to spray the part as it is moving away from the gun on the conveyer. The gun mount thus provides a full range of spraying options and can be used to produce more efficient spraying operation.

Since the gun mount of the present invention is narrower and requires less room for positioning and adjusting, the gun slot within the spray booth may be made narrower. This allows the overall dimensions of the spray booth to be reduced, which, in turn allows a reduction in the fan requirements for the booth. If the cross-sectional area of the gun slot is reduced, the air flow produced by the fan can also be reduced in order to achieve the proper containment air velocity through the gun slot.

Unlike the gun mounts of the prior art, the gun mount of the present invention is formed of conductive metal. The metal parts of the present invention are stronger than the comparable plastic parts of prior art gun mounts, so that gun movement of the nozzle is minimized when the guns are moved, such as when mounted on a reciprocator. Since the metal gun mount assembly of the invention is conductive, it is also specially adapted for mounting of an anti-back-ionization probe.

The present invention provides for an anti-back-ionization (ABI) probe which is mounted directly on the gun mount and which extends from the gun mount along the top or side of the spray gun. The design of the probe of the invention permits it to be easily adjusted or removed. The position of the tip of the probe can be adjusted by providing an adjustable mounting for the probe on the gun mount. Alternatively, a sectional probe can be provided with extension portions which can be added or removed or by providing different probes of different lengths.

These and other advantages are provided by the present invention of a mounting assembly for adjustably mounting a spray gun onto a mounting bar. The mounting assembly comprises a ball-and-socket joint attached at one end to the bar and attached at the other end to the gun, and an adjustment sleeve extending along the exterior of the bar. The sleeve is attached to the ball-and-socket joint and adapted to tighten the socket around the ball when the sleeve is turned to retain the gun securely in a desired position with respect to the bar.

The invention also comprises an electrostatic spray gun assembly, which comprises a spray gun having an electrode, and an anti-back-ionization probe attached to the gun and extending externally to the gun along the side of the gun, the probe comprising an elongated rod.

DETAILED DESCRIPTION OF THE PREFERRED EMBODIMENT

Figure 1:
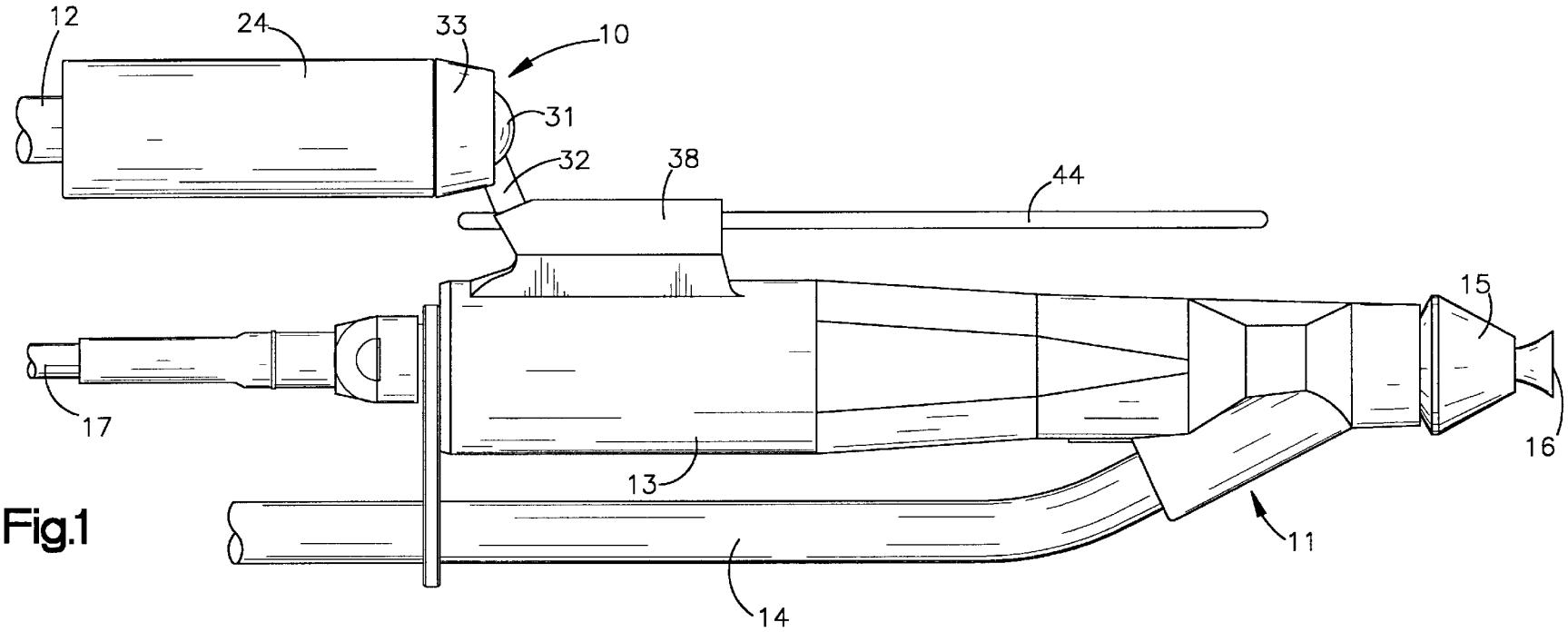
FIG. 1 is a side elevational view of a spray gun having the gun mount assembly of the present invention.

Referring more particularly to the drawings and initially to FIG. 1, there is shown a gun mount assembly 10 for mounting an automatic powder gun 11 on a mounting bar 12. The mounting bar 12 is found in most automatic spraying installations, and the gun mount assembly 10 of this invention is adapted to work with most bars. The gun 11 is of the type commonly used to spray powder entrained in an air flow onto parts, and the gun includes a body 13, a supply hose 14 connected to the body 13 and supplying powder to the outlet nozzle 15 from which the powder is sprayed onto the parts. An electrical charge is imparted to the powder at the nozzle 15 by an electrode 16. The electrode 16 is connected to suitable electrical supply components located within the gun body 13 with electricity supplied to the gun through an electrical supply line 17.

Figure 3:
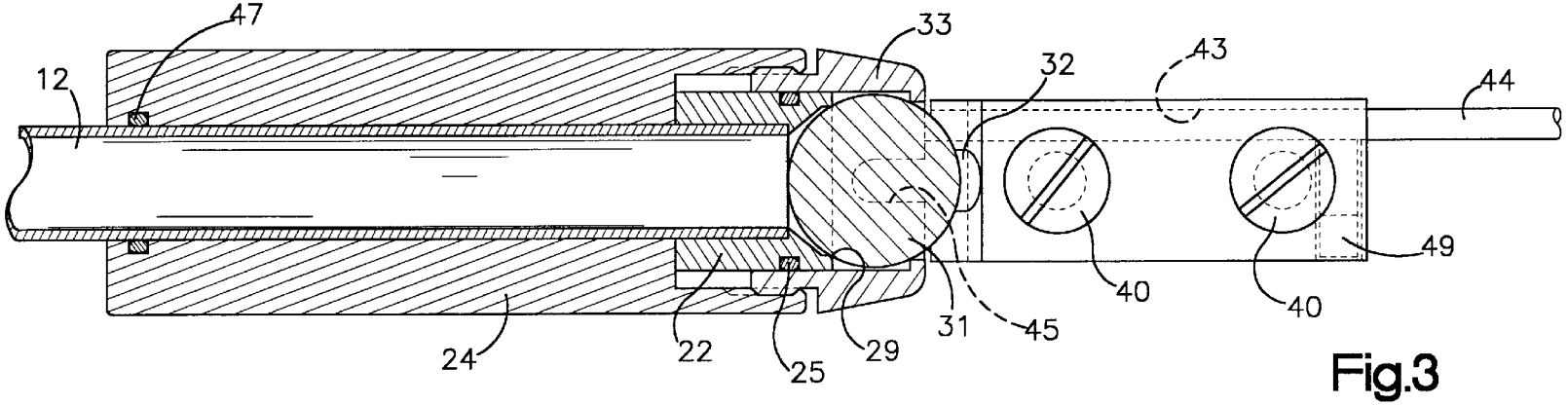
FIG. 3 is a top sectional view of the gun mount assembly taken along line 3—3 of FIG. 2.
Figure 2:
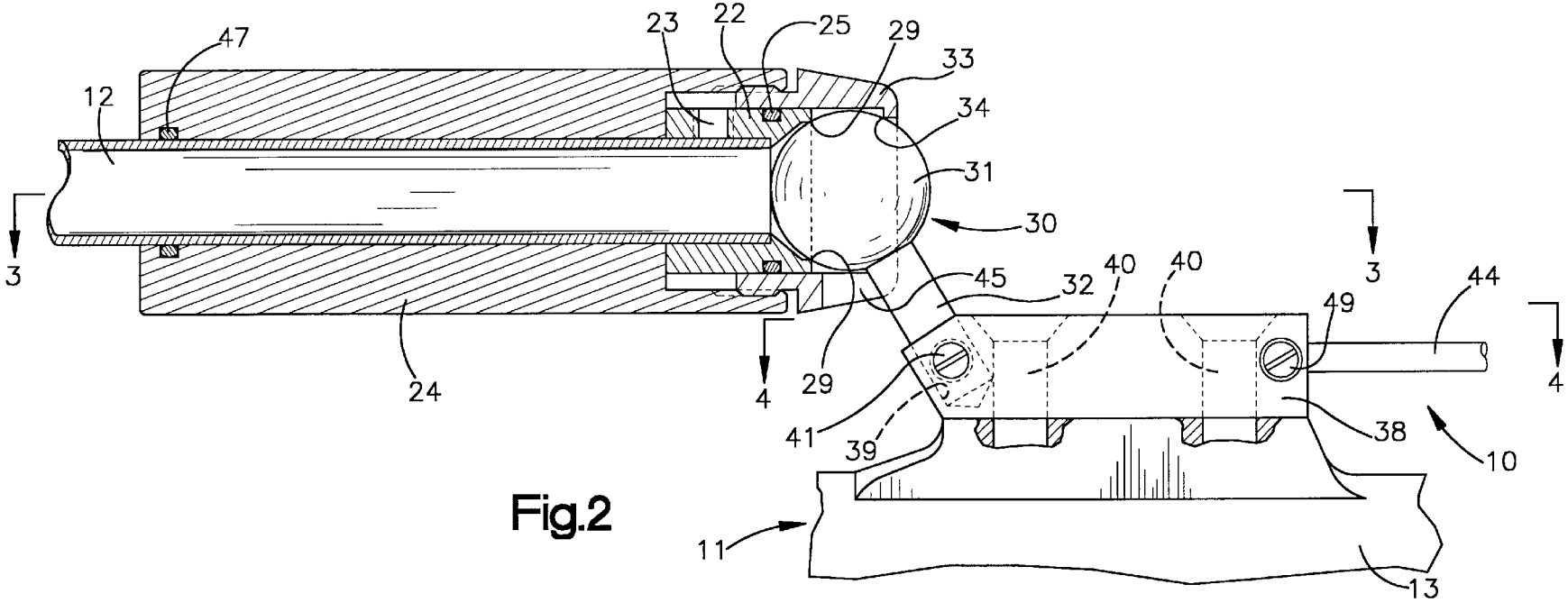
FIG. 2 is a detailed side sectional view of the gun mount assembly of FIG. 1.

As shown in more detail in FIGS. 2 and 3, the gun mount assembly 10 comprises a flange 22 which slides onto the end of the mounting bar 12 and is held onto the bar with one or more set screws 23. A hand adjustment sleeve 24 fits over the flange 22 and extends around the bar 12 to the rear of the flange. The adjustment sleeve 24 slides and turns easily around the outside of the bar 12, but it is not attached to the bar. An O-ring 25 is provided on the outer surface of the flange 22 to prevent powder from entering the annular space between the outside of the flange 22 and the inside of the sleeve 24 in the vicinity of the set screws 23.

The forward end of the flange 22 has a sharp circular edge 29 which engages a ball pivot 30. The ball pivot 30 comprises a ball portion 31 and a stem portion 32. The ball portion 31 rests inside the forward end of the flange 22 on the sharp circular edge 29. A cap 33 is threaded onto the forward end of the sleeve 24. The cap 33 also has a sharp circular edge 34, and the ball portion 31 of the ball pivot 30 also rests on a sharp circular edge 34 inside the cap 33. The flange 22 and the cap 33 thus form the socket of a ball-and-socket joint, with the ball portion 31 of the ball pivot 30 captured between the two parallel circular edges 29 and 34 of the flange 22 and the cap 33, respectively.

The flange 22 and the cap 33 are each made from a hard material, preferably stainless steel, so that they do not tend to deform and loosen the grip on the ball portion 31. The ball pivot 30 is made from aluminum, a softer metal than the cap 33 and the flange 22. Therefore, the sharp, hard edges 34 and 29 on the cap 33 and the flange 22 deform the ball pivot 30 slightly and the two circular indentations help to hold the ball pivot tightly and prevent the gun 11 from moving. The stem portion 32 and the ball portion 31 of the ball pivot 30 can also be made as separate parts instead of being made as a single part. The stem portion 32 could then be made from a much harder and stronger metal, such as stainless steel, and the stem portion would then be fixed attached to the ball portion 31, such as by a permanent press fit, to form the ball pivot 30.

Figure 4:
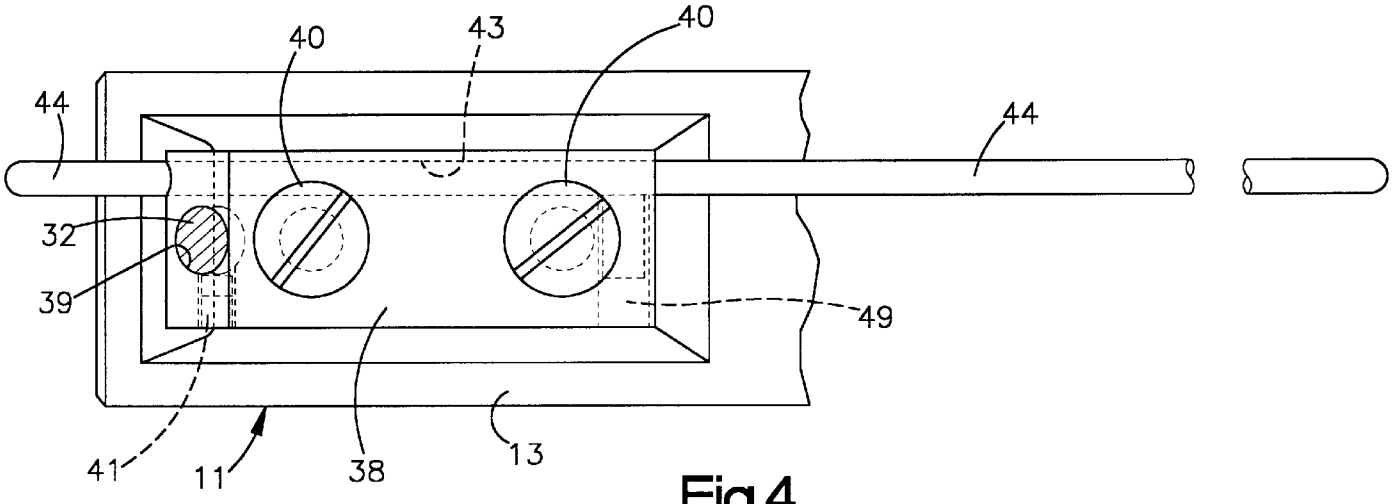
FIG. 4 is a top sectional view of a portion of the gun mount assembly taken along line 4—4 of FIG. 2.

A mounting plate 38 is adapted for attachment to the top of the spray gun 11 using a pair of screws 40. The mounting plate 38 has an opening 39 extending at an angle at one end of the mounting plate, and the stem portion 32 of the ball pivot 30 slides into this opening. Preferably, the opening 39 extends at an angle of 60° relative to the longitudinal axis of the gun 11, i.e., 30° with the vertical when the gun is positioned horizontally. The stem portion 32 has an indentation or drill point on its side which is engaged by the end of one or more set screws 41 (FIGS. 2 and 4) threaded in holes extending from the side face of the mounting plate 38 to removably hold the stem portion 32 in the opening 39, and thereby to removably hold the gun 11 to the mounting bar 12. The set screw 41 is tightened and loosened using an Allen wrench or screw driver. Alternatively, a hand knob may be mounted on the head of the set screw and used to turn the set screw to secure the stem portion 32 of the ball pivot 30 to the mounting plate 38. The knob would make the set screw 41 capable of being adjusted by hand without the need for a tool, but it also increases the overall width of the mounting assembly which may be problem if the gun slot within the spray booth is narrow. Turning or loosening the set screw 41 provides a very convenient way of separating the gun 11 from the mounting bar 12. Otherwise, the sleeve 24 must be unscrewed from the cap 33 to remove the gun. Instead of mounting the stem portion 32 into the opening 39 extending from the top of the mounting plate 38, the opening may extend from the rear face of the mounting plate so that the stem portion 32 extends from the rear of the gun. This would reduce the height of the mounting assembly. Another hole 43 extends through the mounting plate 38 from the front face to the rear face of the mounting plate for mounting and supporting an anti-back-ionization (ABI) probe 44. When the ABI probe 44 is not used, the hole 43 can eliminated or the hole can be filled with a plug or screw to prevent powder from accumulating in it.

The gun mount assembly 10 thus provides for adjustably and securely holding the spray gun 11 in a virtually limitless variety of positions relative to the mounting bar 12. The flexibility of positioning the gun is provided in part by the ball-and-socket joint in which the ball portion 31 which is essentially a sphere, is held within a socket formed between the flange 22 and the cap 33. The cap 33 also has a single groove 45 (FIG. 3) extending from the front edge rearwardly. The groove 45 is large enough to permit the stem portion 32 of the ball pivot 30 to fit within this groove, and the walls of the groove 45 help to support the stem portion. The groove 45 is generally positioned at the bottom of the cap 33, so that the stem portion 32 extends downwardly from the ball portion 31 through the groove. Since the stem portion 32 extends at a fixed orientation relative to the gun, preferably at 60° relative to the longitudinal axis of the gun, due to the fixed attachment of the stem portion at the mounting plate, the groove 45 serves to support the gun 11 in a position in which the gun is pointed downwardly at an angle of 30° relative to horizontal, and it prevents the front of the gun from tilting further downwardly, even though the center of gravity of the gun is forward of its attachment at the mounting plate 38. The positioning of the stem portion 32 in the groove 45 can effectively support the gun 11 in this 30° downwardly pointing position even if the ball portion 31 becomes disengaged from the flange 22 and the cap 33, so that positioning of the gun is maintained even if the operator fails to tighten the mounting assembly sufficiently.

Alternatively, the opening 39 can extend perpendicular to the axis of the gun instead of at an angle of 60° relative to the axis of the gun. This would permit the gun to be held in a fixed horizontal position if the mounting assembly loosens or is not tightened sufficiently.

The position of the gun is locked in place by the engagement of the sharp circular edges 29 and 34 of the flange 22 and the cap 33, respectively, with the ball portion 31. The engagement is made as the hand adjustment sleeve 24 is turned. The sleeve 24 is basically a handle which is threadedly attached to the cap 33 with the flange 22 captured therebetween, so that turning the sleeve 24 engages the threads on the sleeve 24 with the mating threads on the cap 33 and moves the sleeve longitudinally along the bar 12 relative to the cap 33. The sleeve 24 has sufficient length to allow a person to maintain a good grip around it and to turn it. As the sleeve 24 is turned in one direction, the cap 33 is drawn toward the sleeve 24, and the ball pivot 30 is held tighter between the cap 33 and the flange 22, forcing the flange and the cap into engagement with the ball portion 31. As the sleeve 24 is turned in the opposite direction, the cap 33 moves away from the sleeve 24, releasing the ball portion 31 and allowing adjustment of the position of the gun 11. An O-ring 47 is provided on the inner surface of the sleeve 24, between the sleeve and the bar 12, to prevent the sleeve from sliding down the bar when the sleeve is disengaged from the cap 33. The O-ring 47 also provides resistance when turning the sleeve 24 so as to improve the "feel" of the sleeve when it is used by the operator.

The adjustment sleeve 24 is preferably made of plastic in order to minimize the build-up of powder on its outer surface, but the sleeve 24 can be made of metal or other suitable material. As shown in the drawings, the sleeve 24 is cylindrical with a relatively smooth outer surface; however, the sleeve 24 could be square or hexagonal or have flats milled on the outer surface to provide a gripping surface. Flats on the outer surface or a knurled outer surface would make the sleeve 24 easier to grip and turn, particularly if the outer surface is slippery from powder deposited on it. However, such surfaces would also make the sleeve more difficult to clean.

The ABI probe 44 is grounded through the conductive gun mount assembly 10 and the mounting bar 12 which is commonly grounded in a spray booth. Specifically, a conductive path is provided from the ABI probe 44, though the mounting plate 38 in which the probe is mounted, through the ball pivot 30 which is attached to the mounting plate by the set screw 41, and through the flange 22 and the cap 33 which engage the ball pivot, to the mounting bar 12 which is attached to the flange by the set screw 23. The purpose of the ABI probe 44 is to collect ions generated at the charging electrode 16 of the spray gun 11. The probe 44 also creates an electric field which is focused backwardly onto the probe in addition to the electric field which is created by the gun electrode 16 and which is focused forwardly onto the part. In order to collect most of the ions from the charging electrode of the gun, the distance between the tip of the probe and the tip of the charging electrode should be less than the distance between the tip of the charging electrode and the part being sprayed. If this distance relationship is maintained, the electric field between the charging electrode and the probe 44 will be stronger than the electric field between the charging electrode and the part.

By collecting ions with the probe 44 instead of allowing them to deposit on the part, the appearance of the surface finish on the part can be improved. Without the use of the ABI probe, charge would accumulate on the deposited powder layer as the part is sprayed until the local electric field strength is great enough to cause ionization from the powder layer. This "back-ionization" could disturb the deposited powder and result in craters and other defects in the cured coating on the part. By using an ABI probe, these craters and defects are avoided, and a smoother coating is produced. Since the ABI probe collects the ions instead of allowing them to collect on the part, thicker coatings can be produced on the parts because incoming powder is not repelled as quickly by the charged powder deposited. The use of the ABI probe also makes it easier to apply a second coating to parts which have previously been coated because, as previously stated, there is a reduced charge build-up on the part.

Since the electric field which goes from the charging electrode of the gun to the part is weaker because of the ABI probe, the gun should apply a more uniform thickness coating onto the part without a thick coating on the edges closest to the gun. Without the probe, the electric field lines would normally concentrate along edges closest to the gun, and a thick coating could result in these regions. The weaker field which results from the use of the ABI probe should also result in better coating of the Faraday cage areas on the parts without being diverted toward the closest edges by a strong electric field. A corona charging gun with an ABI probe should have similar spray characteristics to a tribocharging gun, since a tribocharging gun does not have a high voltage charging electrode, does not create as many ions, and does not create as strong an electric field between the gun and part.

Various embodiments of the ABI probe can be used. Preferably, the probe 44 is a single rod of conductive material held by a set screw 49 within the opening 43 which extends through the mounting plate 38. Both ends of the probe 44 are rounded in a hemispherical shape. Since the opening 43 extends completely through the mounting plate 38, the probe 44 can be held in any desired position, with any unused length of the probe extending from the rear of the mounting plate. For example, the probe 44 can be made 10-inches long, so that, with 1 inch of the probe mounted within the opening 43 in the mounting plate 38, the probe can extend 9 inches from the mounting plate, or so that, with 2½ inches of the probe extending through the opening 43 and up to 3 inches of the probe extending from the rear of the mounting plate, the probe can extend only as far as 4½ inches from the mounting plate. The length of the probe can also be varied by providing a set of different length probes, so the distance could be adjusted by removing a probe of one length and replacing it with another probe of a different length.

Figure 5:
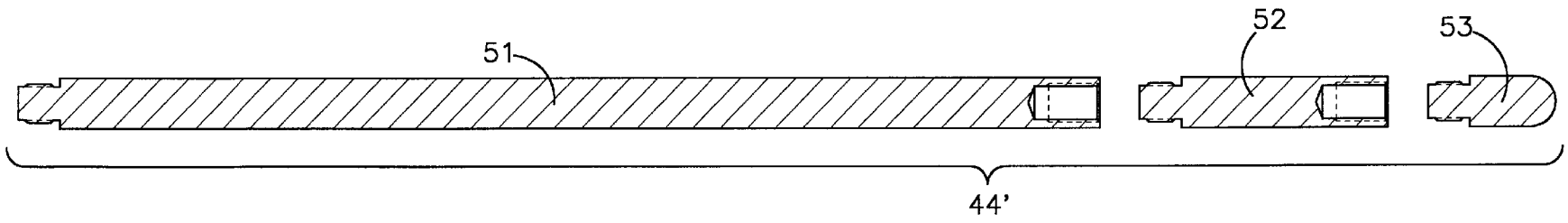
FIG. 5 is a sectional view of another embodiment of the anti-back-ionization probe disassembled.

Alternatively, as shown in FIG. 5, a probe 44' may be provided comprising one or more straight sections 51 and 52 and a rounded tip section 53. One of the straight length sections 51 can be relatively long, such as 6¼ inches, to form the nominal length of the ABI probe 44'. The other of the straight length sections 52 can be an extension which is used if a longer probe is needed. Each extension section 52 can be approximately 1 inch in length, and one or more of these extensions 52 can be used with the base section 51. The tip section 53 is attached to the end of the base section 51 or the final extension section 52 to provide a rounded tip. The sections 51 and 52 each have threaded connecting portions on each end, with a male threaded portion on one end and a female threaded portion on the other end. The section 53 has a male threaded connection portion on one end and a tip on the other end. An opening at the front face of the mounting plate 38 can provide a female threaded connection for one end of the base section 51. The sections 51, 52 and 53 can thus be screwed together to produce a probe 44' which has the desired length to produce the desired effect, and the probe is mounted to extend from the mounting plate 38. The probe sections 51, 52 and 53 are made of a strong and highly conductive material, such as brass or aluminum.

Other probe designs are also possible. For example, the ABI probe could be made in a telescoping design, similar to those used with retractable antennae. As a further alternative, instead of using the set screw 49 to hold the probe 44 in the opening 43, the probe could have an external thread along its length which matches the internal thread in the hole, so that the user could adjust the effective length of the probe simply by turning the probe clockwise or counterclockwise. The probe can also have indicia along its length at regular intervals, for example at ½ inch or 1 inch increments, so that as the effective length of the probe is adjusted, the user would easily ascertain the length of the probe and be able to repeatedly place the probe in this position.

While the ABI probe 44 is preferably mounted to the mounting plate 38 as shown in FIG. 1, the probe may alternatively be mounted directly onto the gun body at a location other than where the gun mount assembly 10 is attached to the gun. For manually operated spray guns, for example, the probe can be mounted on a bracket attached to the side or top of the gun. Various mounting locations for the ABI probe can be used. It is important, however, that the probe be adequately grounded in order to achieve the anti-back-ionization effect.

Other variations and modifications of the specific embodiments herein shown and described will be apparent to those skilled in the art, all within the intended spirit and scope of the invention. While the invention has been shown and described with respect to particular embodiments thereof, these are for the purpose of illustration rather than limitation. Accordingly, the patent is not to be limited in scope and effect to the specific embodiments herein shown and described nor in any other way that is inconsistent with the extent to which the progress in the art has been advanced by the invention.

What is claimed is:

1. An electrostatic spray gun assembly for spraying a coating material onto parts, which comprises:

a spray gun for spraying the coating material, the gun having an elongated body having a longitudinal axis, a supply of coating material connected to the body, and a charging electrode for charging the coating material; and a counter electrode attached to the gun body at an attachment point and extending externally to the gun along the outside of the gun body, the counter electrode being adjustable relative to the attachment point.

2. An electrostatic spray gun assembly, as defined in claim 1, wherein the counter electrode is an elongated rod and is capable of being mounted at the attachment point at different locations along the length of the rod to adjust the position of the counter electrode relative to the charging electrode.

3. An electrostatic spray gun assembly, as defined in claim 1, wherein the counter electrode is comprised of sections which can be assembled and disassembled to vary the length of the counter electrode.

4. An electrostatic spray gun assembly for spraying a coating material onto parts, which comprises:

a spray gun for spraying the coating material, the gun having an elongated body having a longitudinal axis, a supply of coating material connected to the body, and an electrode for charging the coating material; and an anti-back-ionization probe which collects ions produced by the electrode, the probe maintained at a different potential than the electrode, the probe attached to the gun body at an attachment location and extending externally to the gun along the outside of the gun body to a distal tip, the position of the distal tip being adjustable relative to the attachment location.

5. An electrostatic spray gun assembly as defined in claim 4, wherein the probe comprises an elongated rod which extends generally parallel to the longitudinal axis of the gun of the gun body.

6. An electrostatic spray gun assembly as defined in claim 4, wherein the probe is spaced from the gun body.

7. An electrostatic spray gun assembly for spraying a coating material onto parts, which comprises:

a spray gun for spraying the coating material, the gun having an elongated body having a longitudinal axis, a supply of coating material connected to the body, and an electrode for charging the coating material; and a device at a different potential than the electrode for attracting ions produced by the electrode, the device comprising an elongated rod attached to the gun body at an attachment point and extending externally to the gun along the outside of the gun body, the position of the rod being adjustable relative to the attachment point.

8. An electrostatic spray gun assembly as defined in claim 7, wherein the rod is electrically grounded.

9. An electrostatic spray gun assembly as defined in claim 7, wherein the rod is spaced from the gun body.

10. An electrostatic spray gun assembly as defined in claim 7, wherein the rod extends generally parallel to the axis of the gun body.

11. An electrostatic spray gun assembly as defined in claim 7, comprising in addition a gun mounting assembly attached to the gun and connecting the gun to a mounting bar, wherein the rod is attached to the gun body by being attached directly to the mounting assembly.

12. An electrostatic spray gun assembly as defined in claim 11, wherein the gun mounting assembly comprises a ball-and-socket joint attached at one end to the bar and attached at the other end to the gun, and an adjustment sleeve extending along the exterior a portion of the bar, the sleeve attached to the ball-and-socket joint and adapted to tighten the socket around the ball when the sleeve is turned to retain the gun securely in a desired position with respect to the bar.

13. An electrostatic spray gun assembly as defined in claim 12, wherein the adjustment sleeve completely surrounds the bar along a substantial portion of the bar's length.

14. An electrostatic spray gun assembly as defined in claim 12, comprising in addition a mounting plate which attaches said other end of the ball-and-socket joint to the gun.

* * * * *

UNITED STATES PATENT AND TRADEMARK OFFICE

CERTIFICATE OF CORRRECTION

PATENT NO. : 5,957,396
DATED : 9/28/99
INVENTOR(S) : Crum et al.

It is certified that error appears in the above-identified patent and that said Letters Patent is hereby corrected as shown below:

On the title page, item [56]:

U. S. PATENT DOCUMENTS

| EXAMINER INITIAL | | PATENT NUMBER | | | | | | | ISSUE DATE | PATENTEE | CLASS | SUBCLASS | FILING DATE IF APPROPRIATE |
|---|---|---|---|---|---|---|---|---|---|---|---|---|---|
| | | 5 | 3 | 5 | 3 | 9 | 9 | 5 | 10/11/94 | Chabert | | | |
| | | | | | | | | | | | | | |

FOREIGN PATENT OR PUBLISHED FOREIGN PATENT APPLICATION

| | | DOCUMENT NUMBER | | | | | | | PUBLICATION DATE | COUNTRY OR PATENT OFFICE | CLASS | SUBCLASS | TRANSLATION YES | TRANSLATION NO |
|---|---|---|---|---|---|---|---|---|---|---|---|---|---|---|
| | | 3 | 5 | 1 | 0 | 1 | 9 | 9 | 10/02/86 | Gema Ransburg Ag | | | | |
| | | 0 | 6 | 2 | 0 | 0 | 4 | 5 | 10/18/94 | Gema Ransburg Ag | | | | |
| | | 0 | 6 | 3 | 7 | 4 | 6 | 6 | 02/08/95 | Gema Ransburg Ag | | | | |
| | | 0 | 6 | 9 | 7 | 2 | 5 | 5 | 02/21/96 | Chichibu Onoda Cement | | | | |

Signed and Sealed this

Twenty-ninth Day of August, 2000

*Attest:*

*Attesting Officer*

Q. TODD DICKINSON

*Director of Patents and Trademarks*